US008439287B2

(12) United States Patent
Matsuzaki et al.

(10) Patent No.: US 8,439,287 B2
(45) Date of Patent: May 14, 2013

(54) APPARATUS FOR FRACTURING POLYCRYSTALLINE SILICON AND METHOD FOR PRODUCING FRACTURED FRAGMENTS OF POLYCRYSTALLINE SILICON

(75) Inventors: Takahiro Matsuzaki, Naka-gun (JP); Shunsuke Kotaki, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 13/282,676

(22) Filed: Oct. 27, 2011

(65) Prior Publication Data

US 2012/0104126 A1 May 3, 2012

(30) Foreign Application Priority Data

Oct. 28, 2010 (JP) ..... 2010-242060

(51) Int. Cl.
*B02C 13/20* (2006.01)
*B02C 13/09* (2006.01)
*B02C 23/00* (2006.01)

(52) U.S. Cl.
USPC ..... 241/187; 241/189.1; 241/294

(58) Field of Classification Search ..... 241/187, 241/189.1, 293, 294, 191, 195
See application file for complete search history.

(56) References Cited

U.S. PATENT DOCUMENTS

| | | | | |
|---|---|---|---|---|
| 1,889,183 | A * | 11/1932 | Rosenfeld | 241/55 |
| 3,426,674 | A * | 2/1969 | Testolin | 100/95 |
| 4,069,783 | A * | 1/1978 | Morgan | 114/42 |
| 2006/0070569 | A1 | 4/2006 | Andrejewski et al. | |
| 2006/0088970 | A1 | 4/2006 | Hesse et al. | |
| 2009/0114748 | A1 | 5/2009 | Gruebl et al. | |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing polycrystalline silicon has: a pair of rolls which are rotated in a counter direction each other around parallel axes; and a plurality of fracturing teeth protruding outward radially from outer peripheral surfaces of the rolls and having variant heights. In the apparatus for fracturing, the fracturing teeth are arranged so that higher teeth among the fracturing teeth and lower teeth among the fracturing teeth are alternately rowed at least along a circumferential direction or a width direction of the rolls; and the fracturing teeth are arranged so that a tip of the higher tooth of the one roll and a tip of the lower tooth of the other roll are opposed to each other at a position in which the fracturing teeth of each rolls are closest to each other, so that the apparatus fractures fragments of polycrystalline silicon between the rolls.

4 Claims, 5 Drawing Sheets

APPARATUS FOR FRACTURING POLYCRYSTALLINE SILICON AND METHOD FOR PRODUCING FRACTURED FRAGMENTS OF POLYCRYSTALLINE SILICON

CROSS REFERENCE TO RELATED APPLICATIONS

This application is related to four co-pending applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed concurrently herewith as follows: in the names of Ryusuke Tada and Motoki Sato which claims priority to Japanese Patent Application No. 2010-242063 filed Oct. 28, 2010; in the names of Ryusuke Tada and Motoki Sato which claims priority to Japanese Patent Application No. 2010-242062 filed Oct. 28, 2010; in the names of Ryusuke Tada, Takahiro Matsuzaki, Shunsuke Kotaki and Motoki Sato which claims priority to Japanese Patent Application No. 2010-242061 filed Oct. 28, 2010; and in the names of Takahiro Matsuzaki, Teruyoshi Komura, Shunsuke Kotaki and Motoki Sato which claims priority to Japanese Patent Application No. 2010-242059 filed Oct. 28, 2010, which co-pending applications are assigned to the assignee of the instant application and which co-pending applications are also incorporated by reference herein.

BACKGROUND OF THE INVENTION

1. Field of the Invention

The present invention relates to an apparatus for fracturing polycrystalline silicon which is raw material of semiconductor silicon or the like into fragments, and a method for producing fractured fragments of polycrystalline silicon using the apparatus for fracturing.

Priority is claimed on Japanese Patent Application No. 2010-242060, filed Oct. 28, 2010, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 9, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, so that it is inefficient to obtain fragments of appropriate size from rod-shaped polycrystalline silicon.

In Japanese Unexamined Patent Application, First Publication No. 2006-122902, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in Published Japanese Translation No. 2009-531172 of the PCT International Publication and Japanese Unexamined Patent Application, First Publication No. 2006-192423, apparatuses for fracturing roughly-crashed fragments of polycrystalline silicon are proposed. These apparatuses are double-roll crashers having two rolls and crashing the roughly-crashed fragments of polycrystalline silicon between the rolls.

Polycrystalline silicon can be fractured efficiently by such fracturing apparatuses. However, the fragments of polycrystalline silicon which are supplied to the fracturing apparatuses have uneven shape and size, so that long fragments having small width orthogonal to longitudinal direction with respect to the longitudinal size may be incorporated. There is a possibility that the long fragments of polycrystalline silicon are not fractured and pass through the gap between the fracturing teeth.

SUMMARY OF THE INVENTION

Problems to be Solved by the Invention

The present invention is contrived in view of the circumstances, and an object of the present invention is to provide an apparatus for fracturing and a method for producing fractured fragments of polycrystalline silicon in which the fragments of polycrystalline silicon can be prevented from passing through without being fractured, and in which polycrystalline silicon can be efficiently fractured into fragments of appropriate size.

Means for Solving the Problem

An apparatus for fracturing polycrystalline silicon according to the present invention has: a pair of rolls which are rotated in a counter direction each other around parallel axes; and a plurality of fracturing teeth protruding outward radially from outer peripheral surfaces of the rolls and having variant heights. In the apparatus for fracturing, the fracturing teeth are arranged so that higher teeth among the fracturing teeth and lower teeth among the fracturing teeth are alternately rowed at least along a circumferential direction or a width direction of the rolls; and the fracturing teeth are arranged so that a tip of the higher tooth of the one roll and a tip of the lower tooth of the other roll are opposed to each other at a position in which the fracturing teeth of each rolls are closest to each other, so that the apparatus fractures fragments of polycrystalline silicon between the rolls.

By arranging the fracturing teeth having variant heights alternately, spaces between the tips of the fracturing teeth at the facing part of the rolls are sifted along a radial direction of the rolls according to the position of the fracturing teeth. Therefore, even though long fractured fragments are supplied, the fragments are fractured by being in contact with the adjacent fracturing teeth along the circumferential direction or the width direction of the rolls, so that the fractured fragments can be prevented from passing through without being fractured. As a result, the fractured fragments can be reliably fractured into fragments of appropriate size.

In the apparatus for fracturing polycrystalline silicon according to the present invention, it is preferable that: gaps between the fracturing teeth be in a range of not less than 11 mm and not more than 35 mm; distance between the tips of the fracturing teeth at a facing part of the rolls be in a range of not less than 5 mm and not more than 30 mm; and height difference between the higher tooth and the lower tooth among the fracturing teeth be in a range of not less than 10 mm and not more than 20 mm.

By setting the gaps between the fracturing teeth and the distance between the tips as above ranges, the fractured fragments can be reliably in contact with the fracturing teeth.

In the apparatus for fracturing polycrystalline silicon according to the present invention, it is preferable that top surfaces of the fracturing teeth be formed spherically, and side surfaces of the fracturing teeth be formed cylindrically.

The top surfaces of the fracturing teeth are formed spherically, so that the tips of the fracturing teeth and polycrystalline silicon are in contact at points. The side surfaces of the fracturing teeth are formed conically or cylindrically, so that the side surfaces of the fracturing teeth and polycrystalline silicon are in contact in lines. Therefore, since the fracturing teeth and polycrystalline silicon are in contact at points or in lines, polycrystalline silicon can be prevented from being ground into powder by the fracturing teeth.

In the apparatus for fracturing polycrystalline silicon according to the present invention, it is preferable that the fracturing teeth be formed from cemented carbide or silicon material.

By forming the fracturing teeth from cemented carbide or silicon material, the fractured fragments of polycrystalline silicon can be prevented from being contaminated by impurity, so that high-quality polycrystalline silicon as material for semiconductor silicon can be obtained.

A method for producing fractured fragments of polycrystalline silicon according to the present invention products the fractured fragments of polycrystalline silicon by using the apparatus for fracturing polycrystalline silicon described above.

Effects of the Invention

According to the present invention, the fragments of polycrystalline silicon can be prevented from passing through without being fractured, so that polycrystalline silicon can be efficiently fractured into fragments of appropriate size.

DESCRIPTION OF THE PREFERRED EMBODIMENTS

Hereinafter, embodiments of an apparatus for fracturing polycrystalline silicon according to the present invention and a method for producing fractured fragments of polycrystalline silicon using the apparatus will be described with reference to the drawings.

Figure 1:
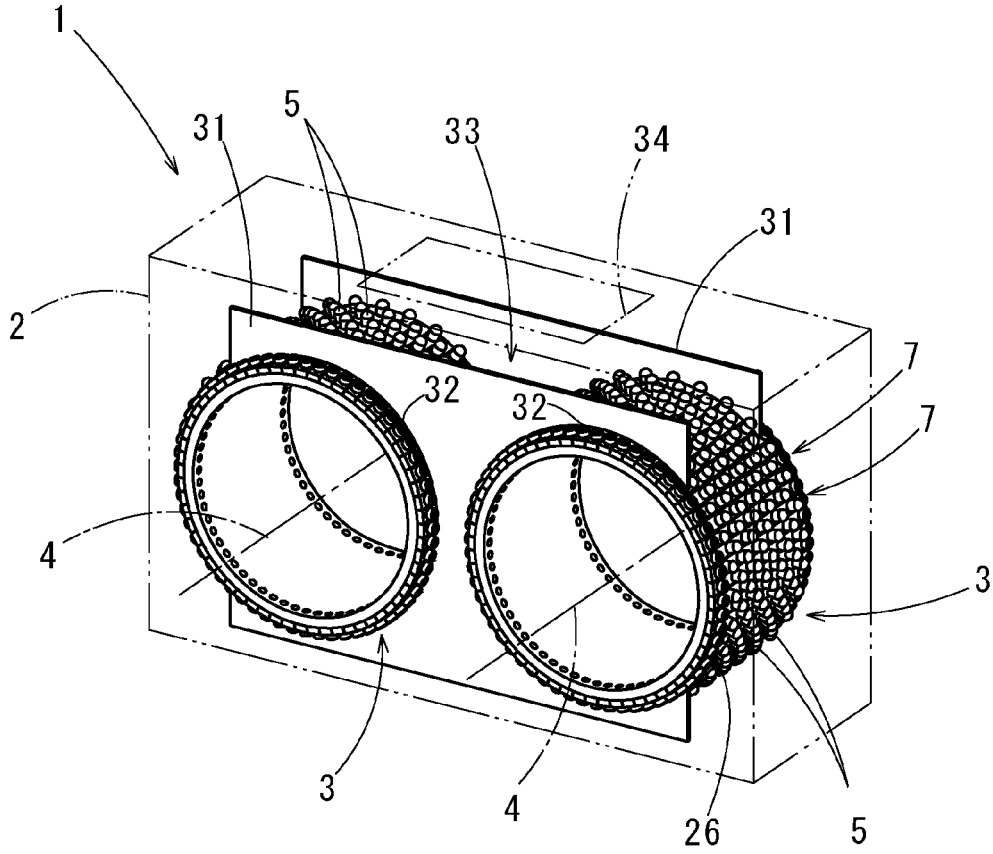
FIG. 1 is a partial perspective view showing an embodiment of an apparatus for fracturing polycrystalline silicon according to the present invention.
Figure 2:
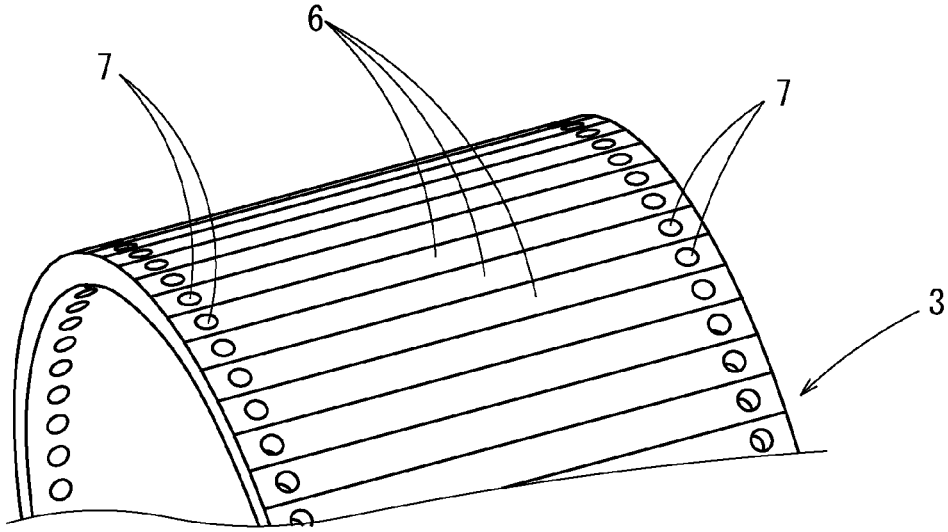
FIG. 2 is a perspective view showing a surface of roll of the apparatus for fracturing shown in FIG. 1.

As shown in FIG. 1, an apparatus 1 for fracturing (herein after, "the fracturing apparatus 1") of a first embodiment is provided with two rolls 3 which are arranged in a housing 2 so that axes 4 of the rolls 3 are horizontal and parallel with each other. A plurality of fracturing teeth 5 having variant heights are provided on an outer peripheral surface of both the rolls 3 so as to protruding radially-outwardly. As shown in FIG. 2, the outer peripheral surfaces of the rolls 3 are not even arc surfaces, but are formed as a polyhedral shape configured from long planes 6 which are elongated along the axis direction and are connected along a circumferential direction. Threaded holes 7 are formed at both ends of the planes 6. On each of the planes 6, a fracturing teeth unit 8 is fixed.

Figure 3:
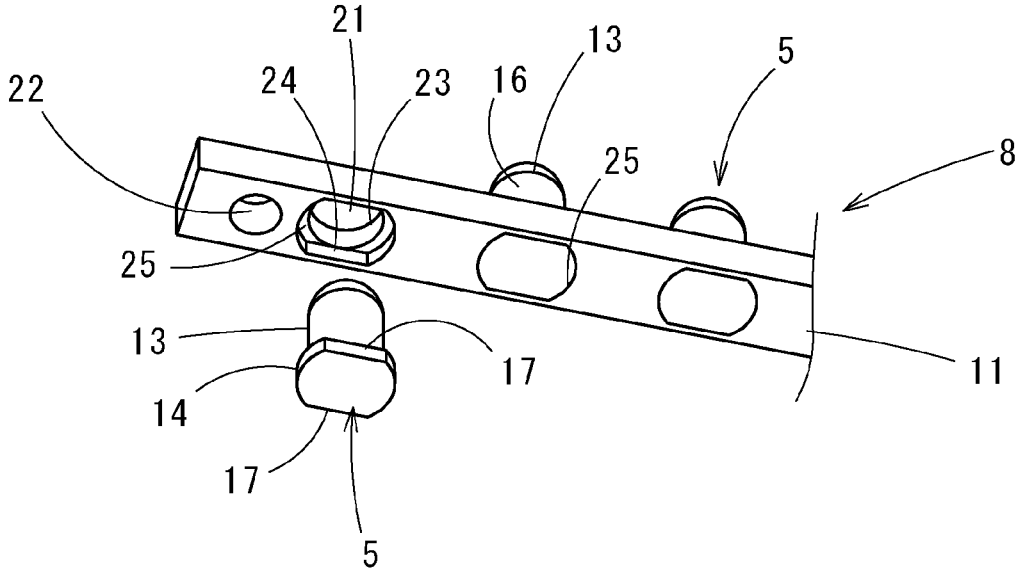
FIG. 3 is a perspective rear view showing a fracturing teeth unit installed in the apparatus for fracturing of FIG. 1.
Figure 4:
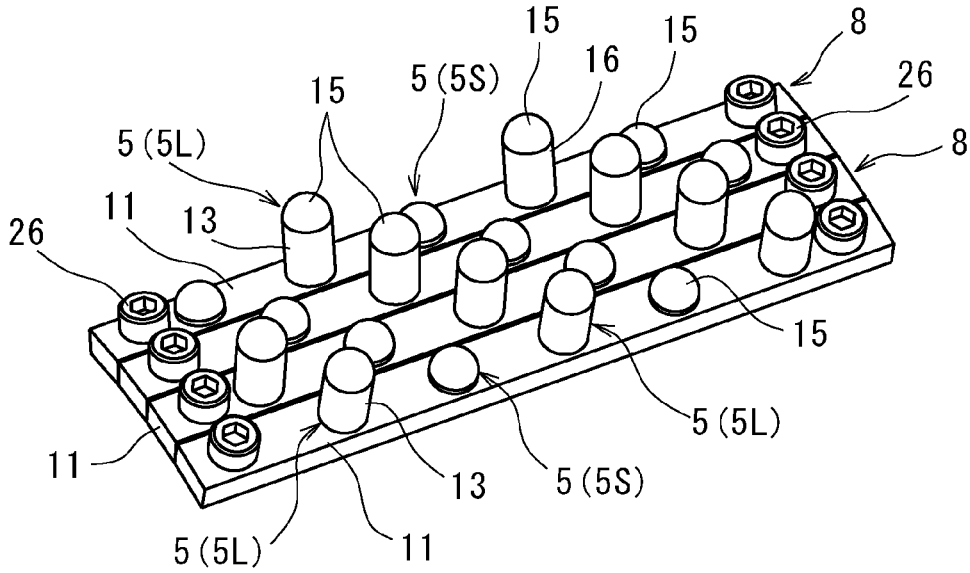
FIG. 4 is a perspective view showing a row of the plurality of the fracturing teeth units.

The fracturing teeth unit 8 is provided with a fixing cover 11 which is in contact with the plane 6 of the roll 3, and the plurality of fracturing teeth 5 which are fixed to the fixing cover 11 as shown in FIG. 3 and FIG. 4.

Figure 5:
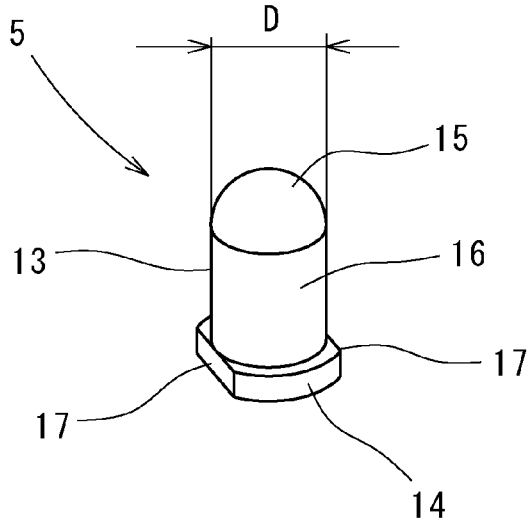
FIG. 5 is a perspective view showing the fracturing tooth.

The fracturing tooth 5 is formed as a unit from cemented carbide or silicon material, and has a column part 13 and a flange 14 which expands in diameter at a base part of the column part 13 as shown in FIG. 5. A top surface 15 of the column part 13 is formed spherically; and a side surface 16 of the column part 13 is formed cylindrically. The flange 14 is formed so that both sides of a circular plate are cut parallel to a longitudinal direction of the column part 13, so that flat parts 17 are formed in 180° opposite direction from each other.

The fixing cover 11 is formed as a strip having a same width and a same length as that of the plane 6 of the roll 3. Fixing holes 21 for fracturing teeth are formed with intervals along a longitudinal direction of the fixing cover 11 so as to penetrate the fixing cover 11. Through-holes 22 for screw are formed at both sides of the fixing cover 11. As shown in FIG. 3, each of the fixing holes 21 is configured with a fit hole 23 and an expanded part 25. The fit hole 23 is formed to a half depth of thickness of the fixing cover 11, and has a circular cross-section corresponding with the side surface 16 of the column part 13 of the fracturing tooth 5. The other half depth of the thickness of the fixing cover 11 of the fixing hole 21 is the expanded part 25 having flat parts 24 corresponding to the flange 14 of the fracturing tooth 5. The fracturing tooth 5 is fixed to the fixing cover 11 so as not to rotate by fitting the flange 14 into the expanded part 25 in a state in which the column part 13 is fitted into the fit hole 23 of the fixing cover 11 and by the flat parts 24 of the fixing cover 11 being in contact with the flat parts 17 of the flange 14.

The fixing cover 11 is laid on each of the planes 6 of the rolls 3 in a state in which the expanded parts 25 face to the surfaces of the rolls 3 and the column parts 13 of the fracturing teeth 5 are protruded from the fit holes 23, and both ends of the fixing cover 11 are fixed to the surfaces of the rolls 3 by screws 26.

Figure 6:
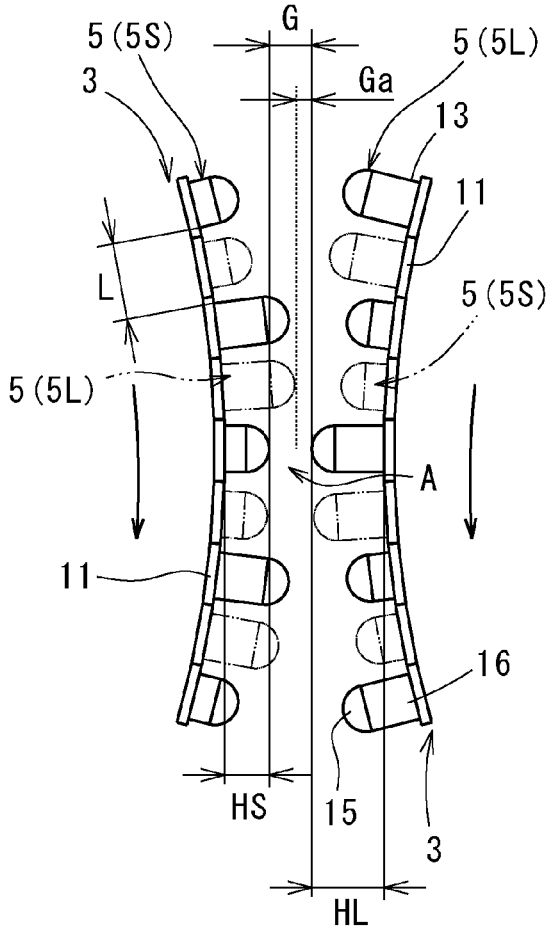
FIG. 6 is a front view showing a positional relation of the rolls at a facing part.

The fracturing teeth units 8 are arranged so that the fracturing teeth 5 of the adjacent fracturing units 8 are not rowed along the circumferential direction of the rolls 3, as shown in FIG. 4 and FIG. 6. That is, the adjacent fracturing teeth units 8 are installed on the rolls 3 so that the fracturing teeth 5 are arranged in a staggered manner. The fracturing teeth 5 are structured from two kinds of teeth, i.e., a high fracturing tooth (higher tooth) 5L having high protruding height from the flange 14 to a tip and a low fracturing tooth (lower tooth) 5S having low protruding height from the flange 14 to a tip as shown in FIG. 4. The high fracturing teeth 5L and the low fracturing teeth 5S are arranged alternately so that the fracturing teeth having the same height are not adjacent along the circumferential direction and a width direction of the rolls 3.

As shown in FIG. 6, between the rolls 3, at a facing part thereof (i.e., at a position in which the fracturing teeth 5 of each rolls 3 are closest each other), the fracturing teeth 5 are arranged so that the top surfaces 15 of the high fracturing teeth 5L of the one roll 3 and the top surfaces 15 of the low fracturing teeth 5S of the other roll 3 are opposed to each other. By arranging the high fracturing teeth 5L and the low fracturing teeth 5S alternately along the circumferential direction and the width direction of the rolls 3, spaces between the top surfaces 15 of the fracturing teeth 5L and 5S at the facing part of the rolls 3 are sifted along a radial direction of the rolls 3 according to the position of the fracturing teeth 5L and 5S.

That is, at the facing part of the rolls 3, the space position denoted by an arrow A which is formed by opposing the high fracturing teeth 5L and the low fracturing teeth 5S is at left side of a center position between the rolls 3. However, when the next high fracturing teeth 5L and the next low fracturing teeth 5S are opposed by rotating the rolls 3, the space position is at right side of the center position between the rolls 3. That is, the space position is shifted left and right along with the rotation of the rolls 3.

In FIG. 6, among the staggered fracturing teeth 5, the fracturing teeth 5 arranged in a same circumferential row are denoted by continuous lines; and the fracturing teeth 5 arranged in the other circumferential row are denoted by two-dot lines.

In this embodiment, target size of fragments of polycrystalline silicon after fracturing (i.e., fractured fragments of polycrystalline silicon) is set in a range of 5 mm to 60 mm in maximum length. In order to obtain the fragments of such size: a diameter D of the column part 13 of the fracturing tooth 5 is set in a range of 10 mm to 14 mm; a protruding height HL of the high fracturing tooth 5L from the surface of the fixing cover 11 to the tip of the high fracturing tooth 5L shown in FIG. 6 is set in a range of 20 mm to 30 mm; a protruding height HS of the low fracturing tooth 5S is set in a range of 10 mm to 20 mm; and a difference between the heights of the high fracturing tooth 5L and the low fracturing tooth 5S is set in a range of 10 mm to 20 mm. A distance L between the adjacent fracturing teeth 5 is set in a range of 11 mm to 35 mm. At the facing part of the rolls 3, a facing distance G between the top surfaces 15 of the fracturing teeth 5L and the fracturing teeth 5S is set in a range of 5 mm to 30 mm.

The housing 2 in which the rolls 3 are set is formed of resin such as polypropylene or the like, or formed of metal having an inner coating of tetrafluoroethylene in order to prevent contamination.

In the housing 2, a pair of partition plates 31 which cross the axes 4 of the rolls 3 are provided at both ends of the rolls 3 with a certain interval with respect to the inner wall surface of the housing 2 so as to be parallel with the inner wall surface of the housing 2. The partition plates 31 are fixed to the housing 2, have two cutouts 32 which are formed by being cut at circular arc shape with slightly larger diameter than that of the rolls 3 so as to engage the half or more of the rolls 3, and are arranged with spanning the rolls 3 in a state in which the cutouts 32 are engaged to the ends of the rolls 3.

In a state in which the partition plates 31 are engaged to the rolls 3, gaps are formed between inner peripheral surfaces of the cutouts 32 of the partition plates 31 and outer peripheral surfaces of the rolls 3 so as not to disturb the rotation of the rolls 3. Also, the screws 26 for fixing the fracturing teeth units 8 which are provided at both the ends of the rolls 3 are positioned outside the partition plates 31 so that spaces above and below the facing part of the rolls 3 are located between the partition plates 31. The space between the partition plates 31 is a fracturing space 33 for polycrystalline silicon. On an upper surface of the housing 2, an inlet 34 is formed so as to be arranged immediately above the fracturing space 33. The partition plates 31 are formed from resin such as polypropylene or the like or metal having inner coating of tetrafluoroethylene, as the housing 2.

The housing 2 is provided with a gearbox or the like (not shown) for rotary-driving the rolls 3. The gearbox is connected to an exhaust system (not shown) so as to exhaust the housing 2 and an inner space of the gearbox.

When fractured fragments of polycrystalline silicon is produced by using the fracturing apparatus 1 configured as described above, in a state of rolling the rolls 3, by supplying roughly-fractured polycrystalline silicon of appropriate size into the fracturing space 33 for polycrystalline silicon between the partition plates 31 through the inlet 34 of the housing 2, the fragments of polycrystalline silicon are further fractured into fragments between the fracturing teeth 5 of the rolls 3.

In the rolls 3, the fracturing teeth 5 are provided so that the high fracturing teeth 5L and the low fracturing teeth 5S are arranged alternately along the circumferential direction and the width direction of the rolls 3. Also, at the facing part of the rolls 3, the spaces between the top surfaces 15 of the fracturing teeth 5L and 5S are sifted along the radial direction of the rolls 3 according to the position of the fracturing teeth 5L and 5S. Even though long fragments of polycrystalline silicon are supplied, the fragments rarely pass through a narrow gap Ga since it is impossible for the long fragments to be supplied with maintaining the aspects for passing through the narrow gaps Ga. Therefore, the long fragments of polycrystalline silicon are fractured by being in contact with the fracturing teeth 5L and 5S adjacent to each other along the circumferential direction and the width direction. As a result, polycrystalline silicon can be prevented from passing through without being fractured, so that polycrystalline silicon can be efficiently fractured into appropriate size.

In the fracturing teeth 5, the top surfaces 15 are formed spherically, so that the top surfaces 15 and polycrystalline silicon are in contact at points. Also, in the fracturing teeth 5, the side surfaces 16 of the column parts 13 are formed cylindrically, so that the side surfaces 16 and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

The partition plates 31 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to have desired size, so that the powder can be prevented from being generated and the loss rate can be reduced.

Furthermore, in the fracturing apparatus 1, since the fracturing teeth 5 are formed from cemented carbide or silicon material, impurities are prevented from contaminating polycrystalline silicon from the fracturing teeth 5. Although the screws 26 which fix the fracturing teeth units 8 are generally made of metal, the screws 26 are not in contact with polycrystalline silicon since the screws 26 are arranged outside the fracturing space 33 for polycrystalline silicon. Furthermore, the partition plates 31 and the housing 2 surrounding the fracturing space 33 for polycrystalline silicon are made from resin such as polypropylene or the like, or are coated by tetrafluoroethylene. Therefore, polycrystalline silicon can be prevented from being contaminated by impurities while fracturing. As a result, according to the fracturing apparatus 1, high-quality polycrystalline silicon for semiconductor material can be obtained.

Furthermore, in the present embodiment, the fracturing teeth units 8 in which the fixing cover 11 holds the fracturing teeth 5 independently with each other are fixed on the surfaces of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26 and the fracturing teeth 5 are only fitted into the fixing holes 21 for fracturing teeth of the fixing cover 11, it is easy to replace the fracturing teeth 5. It is preferable that the fixing cover 11 be made of stainless steel or the like in order to maintain strength. Moreover, it is preferable that the surface of the fixing cover 11 be coated with resin such as polypropylene, tetrafluoroethylene, or the like in order to prevent contamination even if polycrystalline silicon is in contact with the fixing cover 11.

Figure 7:
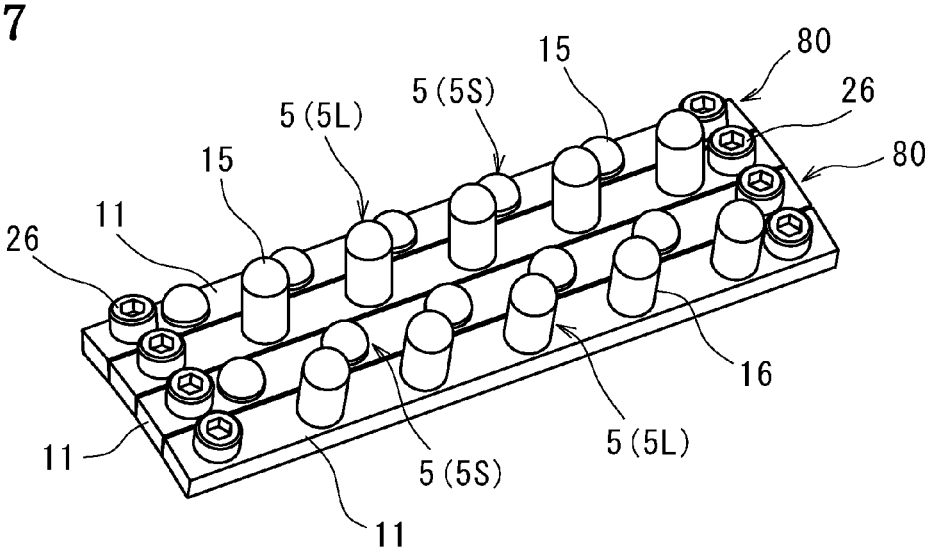
FIG. 7 is a perspective view showing a fracturing teeth unit of a second embodiment.
Figure 8:
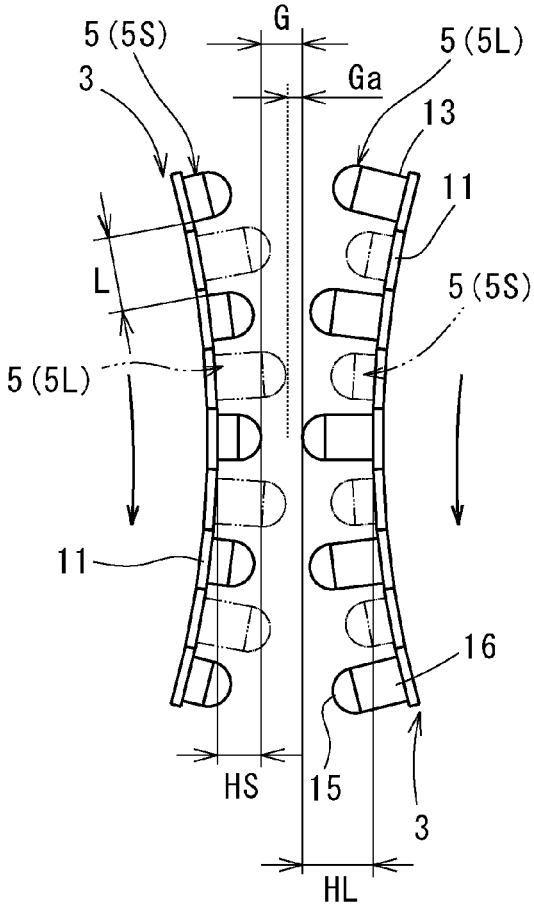
FIG. 8 is a front view showing a positional relation of rolls at a facing part of the second embodiment.
Figure 9:
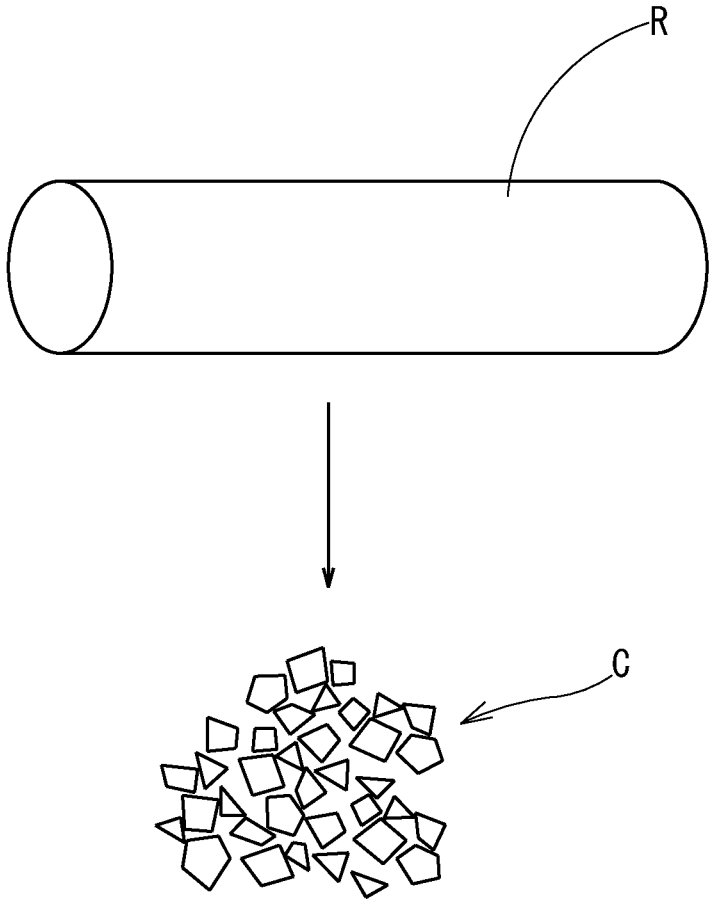
FIG. 9 is a schematic view showing fragments that is obtained by fracturing a rod of polycrystalline silicon.

FIGS. 7 and 8 shows a second embodiment of the present invention. In the fracturing apparatus 1 of the first embodiment, the high fracturing teeth 5L and the low fracturing teeth 5S are arranged alternately along the circumferential direction and the width direction of the rolls 3. In the second embodiment, the high fracturing teeth 5L and the low fracturing teeth 5S are provided so as to be arranged alternately only along the circumferential direction of the rolls 3.

In the apparatus for fracturing in the second embodiment, as shown in FIG. 7, each of fracturing teeth units 80 is provided with the high fracturing teeth 5L or the low fracturing teeth 5S, and the fracturing teeth unit 80 having the high fracturing teeth 5L and the fracturing teeth unit 80 having the low fracturing teeth 5S are fixed alternately along the circumferential direction of the rolls 3.

As shown in FIG. 8, between the rolls 3, the top surfaces 15 of the high fracturing teeth 5L of the one roll 3 and the top surfaces 15 of the low fracturing teeth 5S of the other roll 3 are opposed to each other at the facing position of the rolls 3. By arranging the high fracturing teeth 5L and the low fracturing teeth 5S alternately along the circumferential direction of the rolls 3, the spaces between the top surfaces 15 of the fracturing teeth 5L and 5S at the facing position of the rolls 3 are shifted along the radial direction of the rolls 3 according to the position of the fracturing teeth 5L and 5S.

Therefore, even though long fractured fragments are supplied, the fragments are fractured by being in contact with the fracturing teeth 5L and 5S which are adjacent along the circumferential direction of the rolls 3, so that the fractured fragments are prevented from passing through without being fractured. The other parts of the apparatus for fracturing are the same as those in the above embodiment, denoted by the same reference symbols, and description thereof will be omitted.

The present invention is not limited to the above-described embodiments and various modifications may be made without departing from the scope of the present invention.

For example, the side surfaces of the column parts of the fracturing teeth are formed cylindrically in the above embodiments. However, the side surfaces may be formed conically. Furthermore, the tips of the fracturing teeth may be formed conically so as to be connected with the spherical top surfaces and a cylindrical base part.

Also, dimensions of the facing gaps or the like of the fracturing teeth are not limited to the above-described embodiments.

What is claimed is:

1. An apparatus for fracturing polycrystalline silicon comprising:

a pair of rolls which are rotated in a counter direction each other around parallel axes; and a plurality of fracturing teeth protruding outward radially from outer peripheral surfaces of the rolls and having variant heights, wherein the fracturing teeth are arranged so that higher teeth and lower teeth are alternately rowed at least along a circumferential direction or a width direction of the rolls; and wherein the fracturing teeth are arranged so that a tip of the higher tooth of the one roll and a tip of the lower tooth of the other roll are opposed to each other at a position in which the fracturing teeth of each rolls are closest to each other, the apparatus fracturing fragments of polycrystalline silicon between the rolls.

2. The apparatus for fracturing polycrystalline silicon according to claim 1, wherein gaps between the fracturing teeth are in a range of not less than 11 mm and not more than 35 mm, distance between the tips of the fracturing teeth at a facing part of the rolls is in a range of not less than 5 mm and not more than 30 mm, and height difference between the higher tooth and the lower tooth among the fracturing teeth is in a range of not less than 10 mm and not more than 20 mm.

3. The apparatus for fracturing polycrystalline silicon according to claim 1, wherein top surfaces of the fracturing teeth are formed spherically, and side surfaces of the fracturing teeth are formed cylindrically.

4. The apparatus for fracturing polycrystalline silicon according to claim 1, wherein the fracturing teeth are formed from cemented carbide or silicon material.

* * * * *